US010556456B2

(12) United States Patent
Hamada

(10) Patent No.: US 10,556,456 B2
(45) Date of Patent: Feb. 11, 2020

(54) LIQUID EJECTING APPARATUS

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/045,466

(22) Filed: Jul. 25, 2018

(65) Prior Publication Data

US 2019/0030933 A1 Jan. 31, 2019

(30) Foreign Application Priority Data

Jul. 26, 2017 (JP) ..... 2017-144212

(51) Int. Cl.

| | |
|---|---|
| ***B41J 11/00*** | (2006.01) |
| ***B41J 29/17*** | (2006.01) |
| ***B41J 3/407*** | (2006.01) |
| *B41J 2/01* | (2006.01) |

(52) U.S. Cl.

CPC ..... *B41J 29/17* (2013.01); *B41J 3/4078* (2013.01); *B41J 11/0005* (2013.01); *B41J 11/007* (2013.01); *B41J 11/0015* (2013.01); *B41J 2/01* (2013.01)

(58) Field of Classification Search

CPC ..... B41J 29/17; B41J 11/0005; B41J 3/4078; B41J 11/0015; B41J 11/007; B41J 2/01

See application file for complete search history.

(56) References Cited

U.S. PATENT DOCUMENTS

| | | | | |
|---|---|---|---|---|
| 5,373,312 | A | 12/1994 | Fujioka et al. | |
| 5,530,466 | A | 6/1996 | Fujioka et al. | |
| 5,646,653 | A | 7/1997 | Fujioka et al. | |
| 5,646,668 | A | 7/1997 | Fujioka et al. | |
| 6,341,858 | B1 * | 1/2002 | Saijo | B41J 2/2114 347/101 |
| 2011/0199411 | A1 | 8/2011 | Koike et al. | |
| 2011/0242210 | A1 | 10/2011 | Terada | |
| 2012/0040148 | A1 | 2/2012 | Mozel et al. | |
| 2013/0321524 | A1 * | 12/2013 | Katsuragi | B41M 5/0017 347/21 |

(Continued)

FOREIGN PATENT DOCUMENTS

| | | | |
|---|---|---|---|
| EP | 2910381 | A1 | 8/2015 |
| EP | 2915677 | A1 | 9/2015 |
| JP | 04-039076 | A | 2/1992 |

(Continued)

OTHER PUBLICATIONS

European Search Report issued in Application No. 18185584 dated Dec. 10, 2018.

*Primary Examiner* — Yaovi M Ameh
(74) *Attorney, Agent, or Firm* — Workman Nydegger

(57) ABSTRACT

A liquid ejecting apparatus includes a supporting section configured to support a medium; a first ejecting section capable of ejecting a pretreatment liquid onto the medium supported by the supporting section; a first holding section configured to hold the first ejecting section; and a leveling section provided on the first holding section and being capable of moving between a leveling position in contact with an ejection region to which the pretreatment liquid is ejected and a non-leveling position in non-contact with the ejection region of the medium.

6 Claims, 9 Drawing Sheets

(56) References Cited

U.S. PATENT DOCUMENTS

| | | | | |
|---|---|---|---|---|
| 2015/0273866 | A1* | 10/2015 | Sakai | B41J 11/002 347/21 |
| 2017/0015113 | A1 | 1/2017 | Yamashita | |

FOREIGN PATENT DOCUMENTS

| | | | |
|---|---|---|---|
| JP | 08-216469 | A | 8/1996 |
| JP | 2011-212855 | A | 10/2011 |
| JP | 2015-183339 | A | 10/2015 |
| WO | 2016208177 | A1 | 12/2016 |

* cited by examiner

LIQUID EJECTING APPARATUS

BACKGROUND

1. Technical Field

The present disclosure relates to a liquid ejecting apparatus.

2. Related Art

Liquid ejecting apparatuses in various configurations are used.

An example of such a liquid ejecting apparatus is a liquid ejecting apparatus capable of applying a pretreatment liquid onto a medium, e.g., fabric, before ejecting liquid such as ink onto the medium to form an image on the medium.

For example, JP-A-2015-183339 discloses a recording apparatus (liquid ejecting apparatus) including an ejecting section serving as an image forming ejecting section capable of ejecting ink to form an image onto a recording medium (medium), and a pretreatment section capable of applying the pretreatment liquid onto the medium.

For instance, a medium such as fabric includes fluff in some cases, and the medium is sometimes leveled after the pretreatment liquid is applied onto the medium and before an image is formed on the medium.

The recording apparatus disclosed in JP-A-2015-183339 includes a leveling section such that the medium can be leveled after the pretreatment liquid is applied onto the medium and before an image is formed on the medium.

Meanwhile, users demand prevention of an increase in size of the apparatus.

The recording apparatus disclosed in JP-A-2015-183339, however, includes an ejecting section (ejecting section for image formation), a pretreatment section (pretreatment liquid applying section), and a leveling section separately. Hence, it may be difficult to prevent an increase in size of the apparatus.

This disclosure, therefore, is provided to level a medium onto which a pretreatment liquid is applied in an efficient apparatus configuration.

SUMMARY

A liquid ejecting apparatus according to a first aspect of the disclosure includes a supporting section configured to support a medium, a first ejecting section capable of ejecting a pretreatment liquid onto the medium supported by the supporting section, a first holding section configured to hold the first ejecting section, and a leveling section provided on the first holding section and being capable of moving between a leveling position in contact with an ejection region onto which the pretreatment liquid is ejected and a non-leveling position in non-contact with the ejection region of the medium.

In the first aspect, the leveling section is provided in the first holding section for holding the first ejecting section capable of applying the pretreatment liquid onto the medium. Thus, the medium onto which the pretreatment liquid has been applied can be leveled in an efficient apparatus configuration.

According to the liquid ejecting apparatus of a second aspect of the disclosure, in the first aspect, the first holding section may be capable of performing a reciprocating movement in a scanning direction, the first ejecting section may be configured to eject the pretreatment liquid in accordance with the reciprocating movement of the first holding section, and the leveling section may be provided at the first holding section to move with the first ejecting section.

In the second aspect, the leveling section is provided at the holding section (first holding section) of the first ejecting section in the configuration for ejecting the pretreatment liquid, while the first ejecting section is reciprocating in the scanning direction.

Therefore, the number of the reciprocating movements of the first holding section (i.e., the number of times of leveling by the leveling section) over the medium (ejection region) can be increased by, for example, ejecting the pretreatment liquid in multipaths. Thus, the medium can be leveled effectively.

According to the liquid ejecting apparatus of a third aspect of the disclosure, in the second aspect, the leveling section may include a first leveling section to be provided on a first side of the first ejecting section in the scanning direction and a second leveling section to be provided on a second side of the first ejecting section in the scanning direction.

In the third aspect, the first leveling section is provided on the first side of the first ejecting section in the scanning direction and the second leveling section is provided on the second side of the first ejecting section in the scanning direction. Thus, the medium can be leveled effectively using the leveling sections.

According to the liquid ejecting apparatus of a fourth aspect of the disclosure, in the third aspect, the leveling section may be configured such that, in a case where the first ejecting section moves from the first side toward the second side in the scanning direction, the first leveling section may be set as the leveling position and the second leveling section may be set as the non-leveling position, and in a case where the first ejecting section moves from the second side toward the first side in the scanning direction, the second leveling section may be set as the leveling position and the first leveling section may be set as the non-leveling position.

In the fourth aspect, in the reciprocating movement of the first holding section in the scanning direction, the leveling section located on the rear side of the movement direction is set as the leveling position and the leveling section located on the front side of the movement direction is set as the non-leveling position.

In the case where the medium is leveled by the leveling section on the rear side of the movement direction, undesired interference between the leveling section and the medium (e.g., hooking the leveling section on the medium to adversely affect the reciprocating movement of the first holding section or generate a wrinkle on the medium) can be decreased, in comparison to the case where the medium is leveled by the leveling section on the front side of the movement direction.

According to the liquid ejecting apparatus of a fifth aspect of the disclosure, in any of the second to fourth aspects, the first holding section may be configured to move a plurality of times together with the leveling section in the scanning direction over a predetermined part of the medium.

In the fifth aspect, the first holding section and the leveling section are configured to move multiple times in the scanning direction over the predetermined part of the medium. Thus, the number of the reciprocating movements of the first holding section over the medium (ejection region) (i.e., the number of times of leveling by the leveling section) can be increased, and the medium can be leveled effectively.

According to the liquid ejecting apparatus of a sixth aspect of the disclosure, in any of the second to fifth aspects, the liquid ejecting apparatus may further include a second ejecting section capable of ejecting an image forming liquid, and a second holding section configured to hold the second ejecting section and being capable of performing a reciprocating movement in the scanning direction. In the reciprocating movement of the first holding section and the reciprocating movement of the second holding section, start and stop timings of the first holding section may be configured to coincide with start and stop timings of the second holding section.

In the sixth aspect, the start and stop timings of movement of the first holding section coincide with the start and stop timings of movement of the second holding section in the reciprocating movement of the first holding section and the reciprocating movement of the second holding section.

Therefore, in a configuration for transporting the medium while the first and second holding sections are stopped, and for stopping the transportation of the medium while the first and second holding section are moving (at the time of ejection), driving timings of the first and second holding sections and transportation timings of the medium can be controlled simply.

According to the liquid ejecting apparatus of a seventh aspect of the disclosure, in the sixth aspect, a movement direction of the first holding section may be configured to be opposite to a movement direction of the holding section for image forming.

In the seventh aspect, the movement direction of the first holding section is opposite to the movement direction of the second holding section (the first and second holding sections move alternately). Hence, an occurrence of a large disproportion of weight balance of the liquid ejecting apparatus in the scanning direction in accordance with the movement of the first and second holding sections can be prevented.

According to the liquid ejecting apparatus of an eighth aspect of the disclosure, in any of the second to fourth aspects, the liquid ejecting apparatus may further include a second holding section including a second ejecting section capable of ejecting the image forming liquid, the second holding section being capable of reciprocating in the scanning direction. In the reciprocating movement of the first holding section and the reciprocating movement of the second holding section, a reciprocating speed of the first holding section may be configured to differ from a reciprocating speed of the second holding section.

In the eighth aspect, the reciprocating speed of the first holding section differs from the reciprocating speed of the second holding section in the reciprocating movement of the first and second holding sections.

Therefore, when, for example, the reciprocating speed of the first holding section is made faster than the reciprocating speed of the second holding section, a sufficient amount of the pretreatment liquid can be applied and sufficient leveling can be carried out.

In addition, the sufficient amount of the image forming liquid can be applied by, for example, increasing the reciprocating speed of the second holding section faster than the reciprocating speed of the first holding section.

Note that the phrase "a reciprocating speed of the first holding section is configured to differ from a reciprocating speed of the second holding section" is intended to include, a case where the movement speed is different between the first and second holding sections and a case where, for example, the movement speeds of the first and second holding sections are identical, but the stop times (time taken for changing the movement direction from one direction to the other direction) of the first and second holding sections are different.

According to the liquid ejecting apparatus of a ninth aspect of the disclosure, in any of the first to fifth aspects, the liquid ejecting apparatus may further include a second ejecting section capable of ejecting an image forming liquid onto the ejection region. The first holding section may be configured to hold the second ejecting section, and the leveling section may be configured to be located at the non-leveling position when the second ejecting section discharges the image forming liquid.

In the ninth aspect, the first holding section holds the second ejecting section that discharges the image forming liquid and the first ejecting section that discharges the pretreatment liquid. This configuration eliminates the need for the holding section for the second ejecting section to be provided separately.

In addition, the leveling section is located at the non-leveling position when the second ejecting section ejects the image forming liquid. Thus, a decrease in image quality caused by the leveling section that touches the image forming liquid applied in the ejection region during image formation can be prevented.

According to the liquid ejecting apparatus of a tenth aspect of the disclosure, in any of the first to ninth aspects, the leveling section may include a contact member configured to contact the medium when the leveling section is located at the leveling position, and an arm member configured to connect the contact member and the first holding section, and the leveling section may be configured to displace between the leveling position and the non-leveling position by the swing of the arm member with respect to the first holding section.

In the tenth aspect, the leveling section includes the contact member and the arm member, and the leveling section may be configured to displace between the leveling position and the non-leveling position by the swing of the arm member with respect to the first holding section. Thus, the leveling section can easily be changed between the leveling position and the non-leveling position by the swing of the arm member.

According to the liquid ejecting apparatus of any of an eleventh aspect of the disclosure, in any of the first to tenth aspects, the liquid ejecting apparatus may further include a cleaning section configured to clean the leveling section.

In the eleventh aspect, the cleaning section configured to clean the leveling section is provided, and contamination or the like attached to the leveling section can be removed.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Hereinafter, a printing apparatus 1 embodying the liquid ejecting apparatus according to several examples of the disclosure will be described in detail with reference to the appended drawings.

Example 1 (FIGS. 1 to 7)

Figure 1:
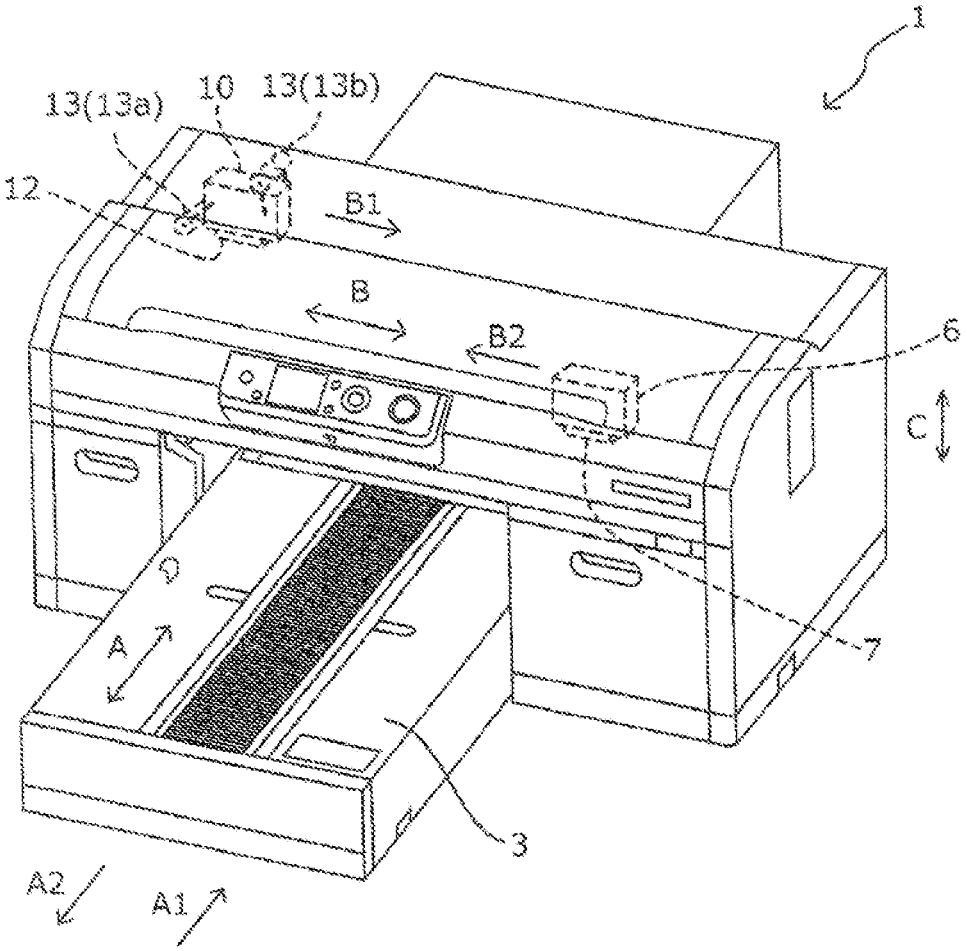
FIG. 1 is a schematic perspective view of a printing apparatus according to Example 1 of the disclosure.

FIG. 1 is a schematic perspective view of a printing apparatus 1 according to Example 1, illustrating a state in which a medium support unit 2 is located at a printing start position.

Figure 2:
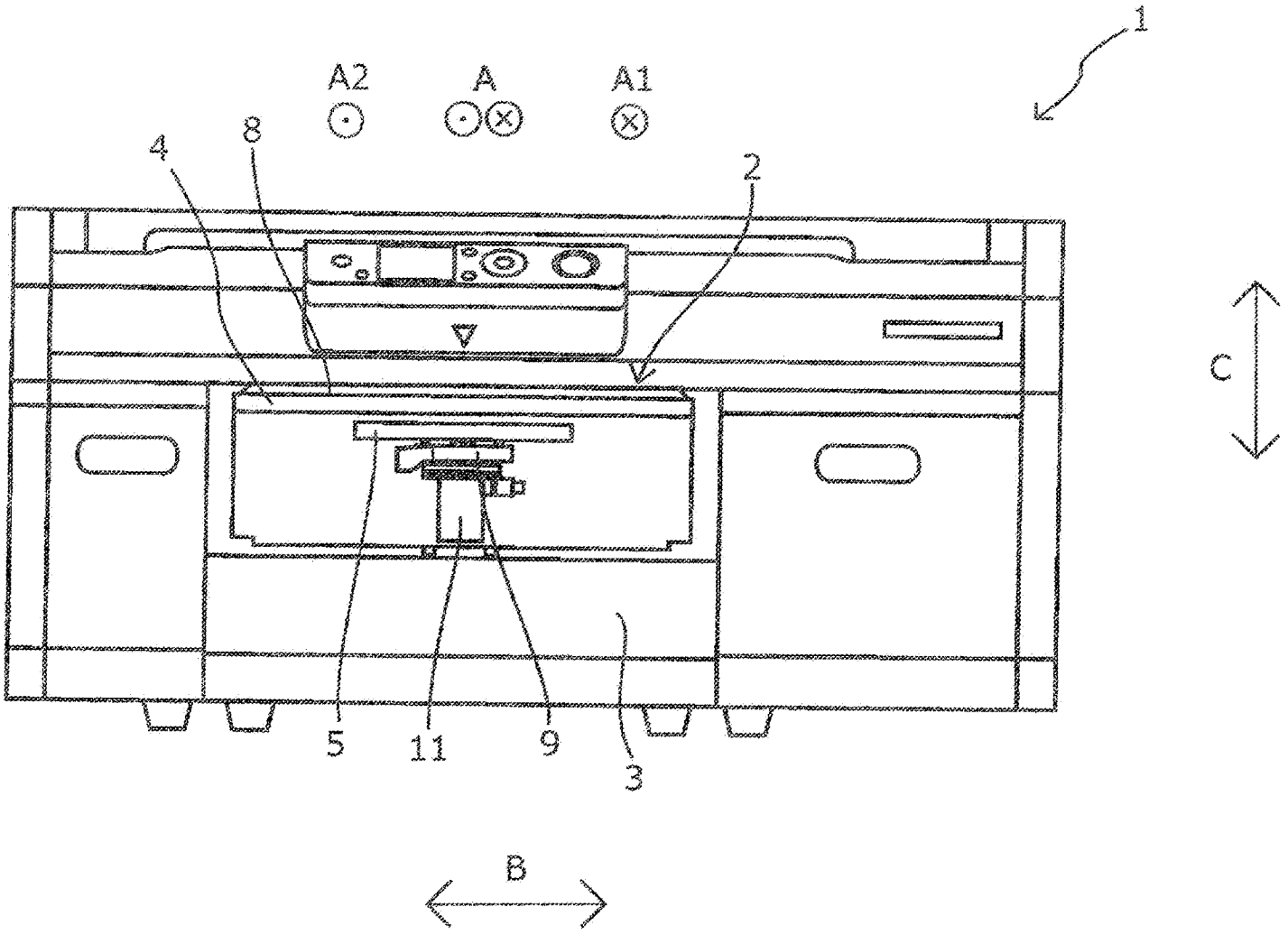
FIG. 2 is a schematic front view of the printing apparatus according to Example 1 of the disclosure.

FIG. 2 is a schematic front view of the printing apparatus 1 according to Example 1.

Figure 3:
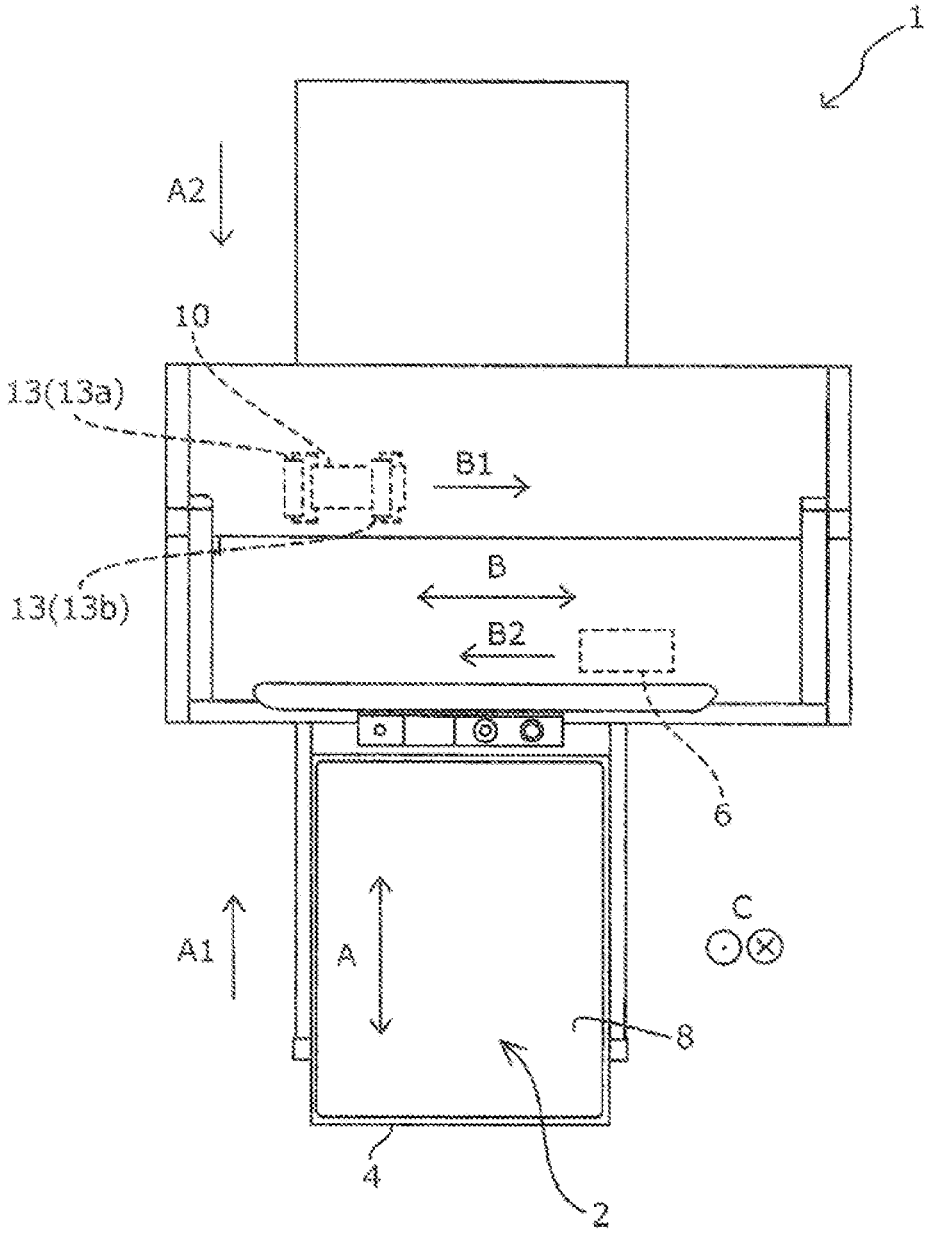
FIG. 3 is a schematic plan view of the printing apparatus according to Example 1 of the disclosure.

FIG. 3 is a schematic plan view of the printing apparatus 1 according to Example 1 and illustrates a state in which the medium support unit 2 is located at a medium set position.

Note that FIGS. 1 to 3 illustrate some constituent elements in a simplified manner.

The printing apparatus 1 in Example 1 includes the medium support unit 2.

Figure 5:
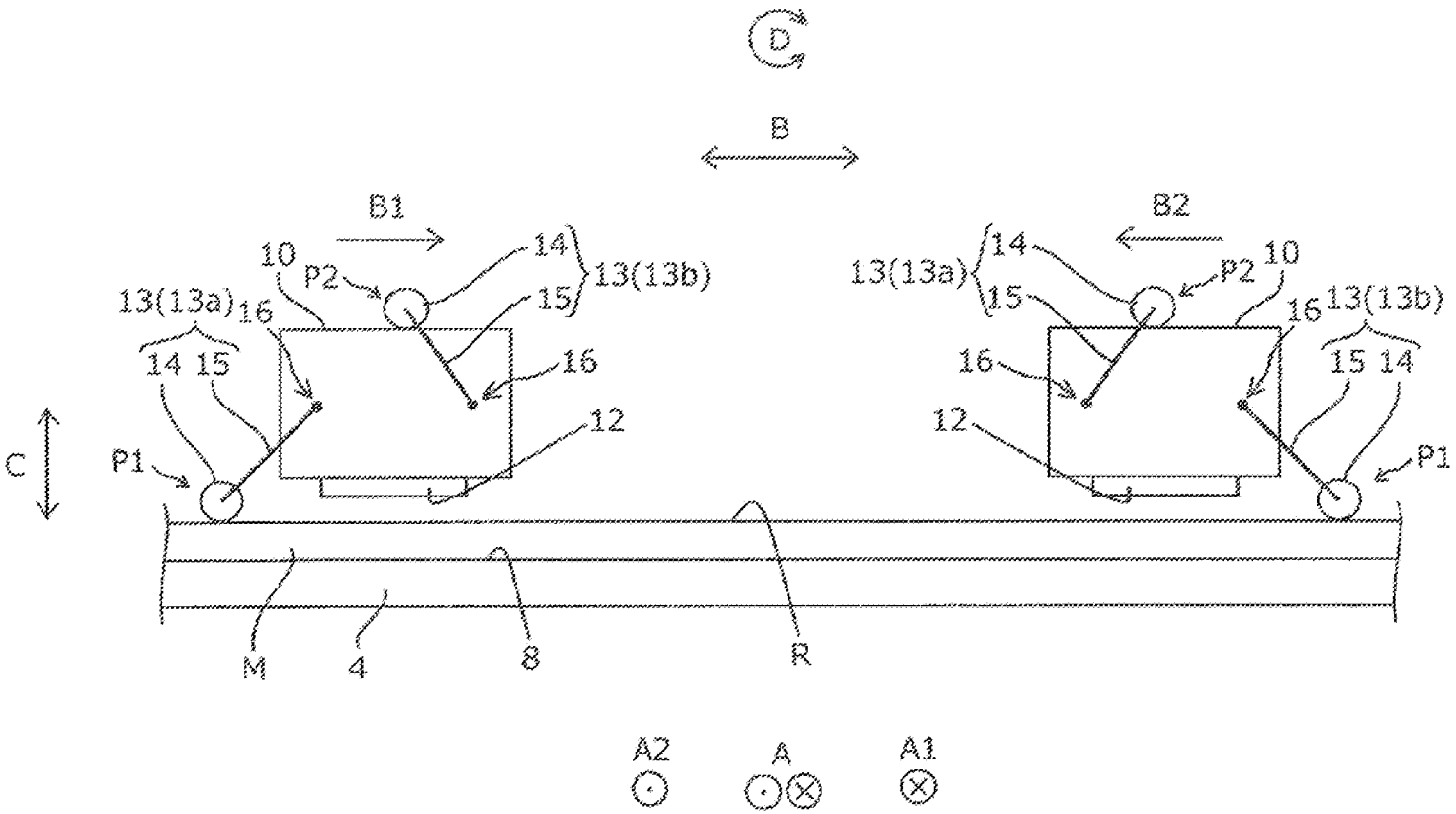
FIG. 5 is a schematic front view of major components of the printing apparatus according to Example 1 of the disclosure.
Figure 6:
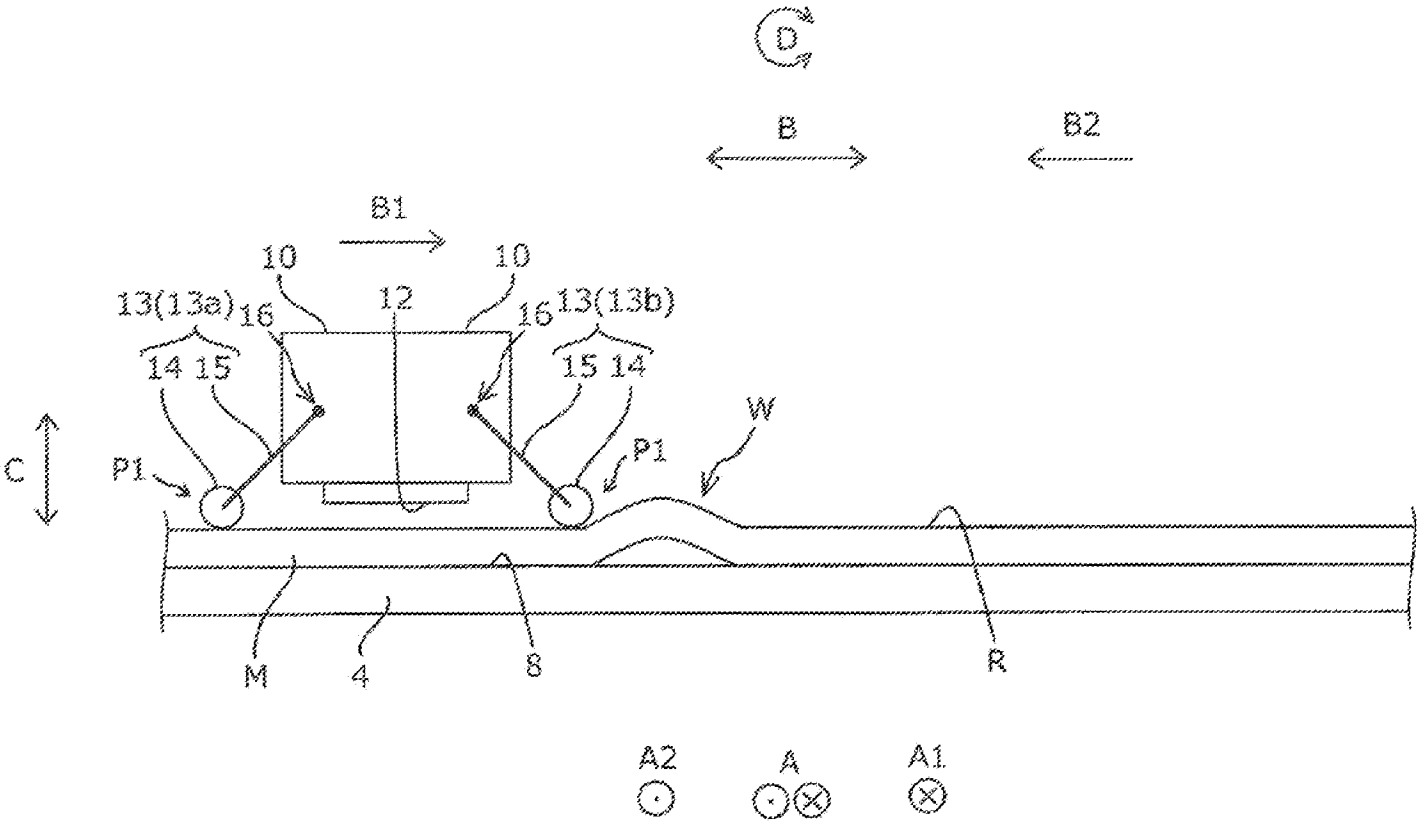
FIG. 6 is a schematic front view of major components the printing apparatus according to Example 1 of the disclosure.

The medium support unit 2 includes a tray 4 serving as a support section, and the tray 4 has a support surface 8 that supports a medium M (see FIGS. 5 and 6).

The medium support unit 2 moves in a tray movement direction A with the medium M supported on the support surface 8 of the tray 4.

The printing apparatus 1 also includes a medium transport unit 3 that transports the medium M supported on the tray 4 in the tray movement direction A.

The tray movement direction A includes a direction A1 and a direction A2 opposite to the direction A1.

The medium support unit 2 is detachably installed on a stage 5.

Here, an attachment and detachment direction C, in which the medium support unit 2 is attached to or detached from the stage 5, corresponds to the vertical direction of the printing apparatus 1 of Example 1.

The medium support unit 2 moves in the attachment and detachment direction C (vertical direction) along with the stage 5 by the rotation of a lever 9.

Note that, as illustrated in FIG. 2, the lever 9 is provided at an arm section 11.

A variety of materials can be used as the medium M, including textiles (e.g., fabrics or cloths), paper, a vinyl chloride resin, and the like.

The printing apparatus 1 in Example 1 is configured to allow application of a pretreatment liquid onto an image formation region (ink ejection region) before forming an image on the medium M, and further allow leveling of the region onto which the pretreatment liquid has been applied.

Specifically, the printing apparatus 1 includes, in its interior, a carriage 10 serving as a first holding section, the carriage 10 having a pretreatment liquid head 12 serving as an ejecting section (first ejecting section) capable of ejecting the pretreatment liquid.

The pretreatment liquid is a liquid to be applied onto the medium M before an image forming liquid used for forming an image is applied onto the medium M.

The pretreatment liquid is used, for example, to facilitate fixing of the image forming liquid on the medium M.

The printing apparatus 1 of Example 1 is configured to allow discharge of the liquid (pretreatment liquid) from the pretreatment liquid head 12 to the medium M supported on the tray 4, while the carriage 10 is reciprocating in the scanning direction B.

The carriage 10 includes a leveling section 13 capable of leveling the region to which the pretreatment liquid is applied.

Note that the carriage 10 that is a major component of the printing apparatus 1 of Example 1 will be described in detail later.

The printing apparatus 1 includes, in its interior, a print head 7 serving as an image-forming ejecting section (second ejecting section) capable of printing on the medium M by ejecting ink as an example of the image forming liquid from a nozzle which is not illustrated.

The printing apparatus 1 of Example 1 causes a carriage 6, which serves as a second holding section on which the print head 7 is held, to reciprocate in the scanning direction B intersecting the tray movement direction A, so that the printing apparatus 1 ejects the ink from the print head 7 onto the medium M supported on the tray 4 to form a desired image, while the print head 7 is reciprocating in the scanning direction B.

Note that in the printing apparatus 1 of Example 1, the front side (lower-left side) of FIG. 1 corresponds to the set position for setting the medium M on the tray 4 (see FIG. 3).

The tray 4 on which the medium M is set is moved in a direction A1 of the movement direction A until the tray 4 reaches the printing start position that corresponds to the rear side (upper-right side) of FIG. 1. The printing is then carried out while the tray 4 is moved in a direction A2 of the movement direction A.

Note that FIGS. 1 and 3 illustrate a state in which the carriage 10 moves in a going direction B1 of the scanning direction B and the carriage 6 moves in a returning direction B2 of the scanning direction B.

The electrical configuration of the printing apparatus 1 in Example 1 will be described below.

Figure 4:
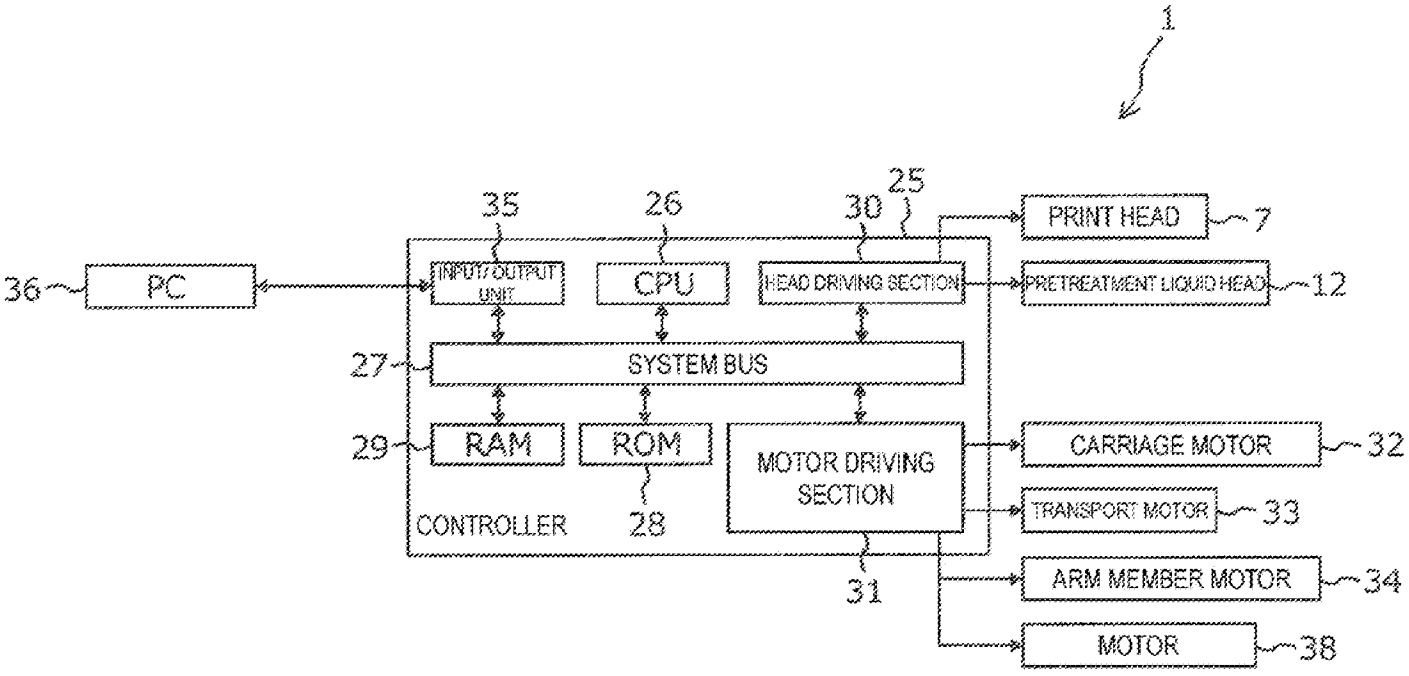
FIG. 4 is a block diagram illustrating the printing apparatus according to Example 1 of the disclosure.

FIG. 4 is a block diagram illustrating the printing apparatus 1 in Example 1.

A central processing unit (CPU) 26 that controls the printing apparatus 1 as a whole is provided in a controller 25.

The CPU 26 is connected, via a system bus 27, to a read only memory (ROM) 28 storing various control programs and the like executed by the CPU 26, and a random access memory (RAM) 23 in which the CPU 26 can store data temporarily.

The CPU 26 is also connected, via the system bus 27, to a head driving section 30 for driving the print head 7 and the pretreatment liquid head 12.

The CPU 26 is furthermore connected, via the system bus 27, to a motor driving section 31.

The motor driving section 31 is connected to a carriage motor 32 for moving, in the scanning direction B, the carriage 6 on which the print head 7 is disposed and the carriage 10 on which the pretreatment liquid head 12 is disposed, a transport motor 33 for transporting the medium M (or for moving the tray 4 in the tray movement direction A), an arm member motor 34 for swinging an arm member 15, which is a constituent member of the leveling section 13, which will be described later, and a rotating section motor 38 for rotating a rotating section 17 (see FIG. 7) which will be described later.

The CPU 26 is furthermore connected, via the system bus 27, to an input and output unit 35.

The input and output unit 35 is connected to a PC 36.

Next, the carriage 10 which is a major component of the printing apparatus 1 in Example 1 is described.

Figure 7:
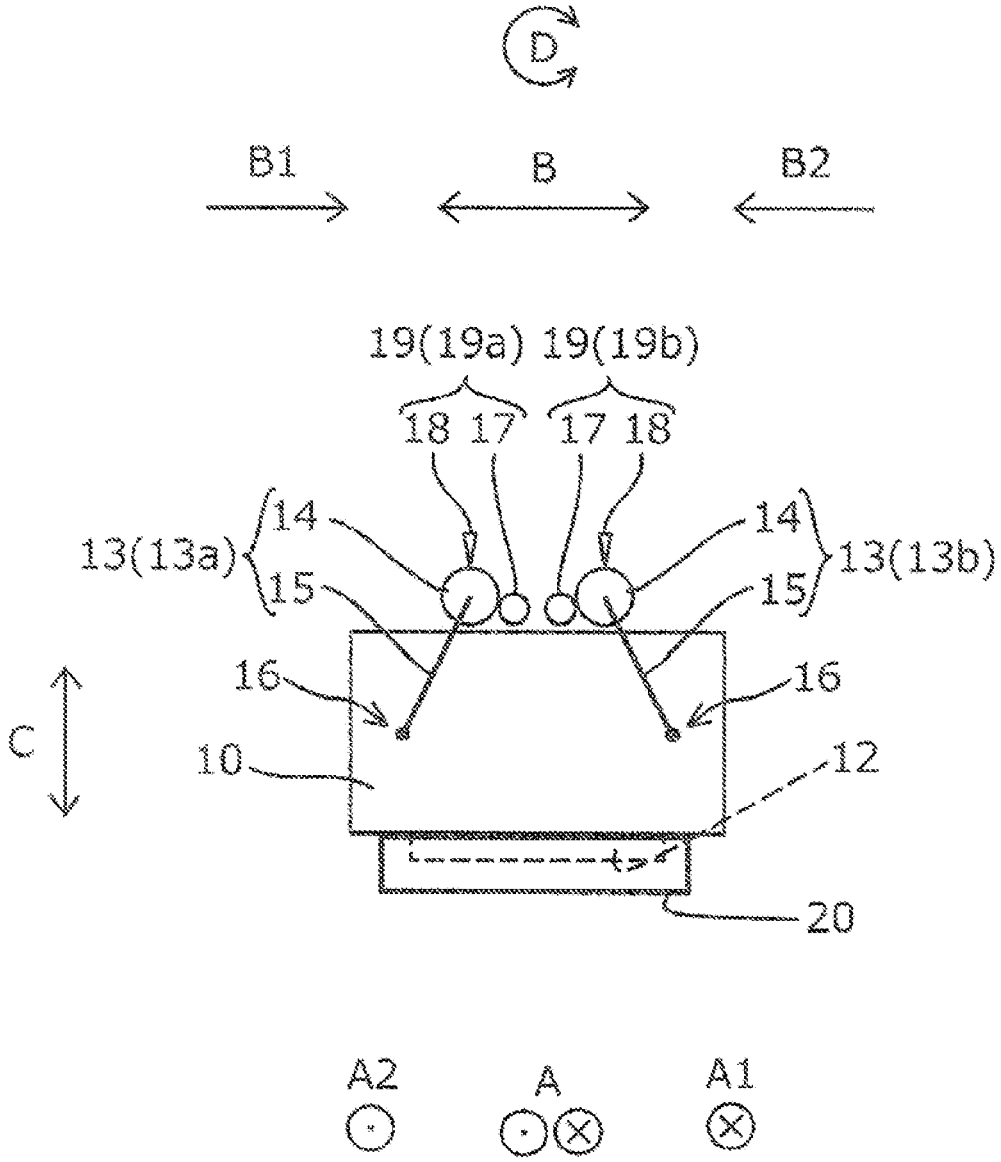
FIG. 7 is a schematic front view of major components of the printing apparatus according to Example 1 of the disclosure.

FIGS. 5 to 7 are schematic front views of the carriage 10 of the printing apparatus 1 in Example 1.

FIG. 5 illustrates the arrangement of two leveling sections 13 provided on the carriage 10 when the two leveling sections 13 are driven in a first leveling mode.

FIG. 6 illustrates the arrangement of the two leveling sections 13 provided on the carriage 10 when two leveling sections 13 are driven in a second leveling mode.

Note that, in FIG. 5, the carriage 10 is illustrated at both positions of the leveling sections 13, which are located at the position where the carriage 10 moves in the going direction B1 of the scanning direction B (the carriage 10 illustrated on the left side of FIG. 5), and the position where the carriage 10 moves in the returning direction B2 of the scanning direction B (the carriage 10 illustrated on the right side of FIG. 5).

Thus, the two carriages 10 are illustrated in FIG. 5, but one carriage 10 alone is provided in practice, as illustrated in FIGS. 1 and 3, in the printing apparatus 1 of Example 1.

As illustrated in FIGS. 5 and 6, the carriage 10 of Example 1 includes the leveling sections (first and second leveling sections 13*a* and 13*b*) respectively arranged on each side of the pretreatment liquid head 12 in the scanning direction B.

The leveling sections 13 are capable of contacting the medium M for leveling the medium M.

Specifically, the printing apparatus 1 of Example 1 includes the tray 4 that supports the medium M, the pretreatment liquid head 12 capable of ejecting the pretreatment liquid onto the medium M that is supported on the tray 4, and the carriage 10 serving as the first holding section holding the pretreatment liquid head 12. As illustrated in FIGS. 5 and 6, the printing apparatus 1 of Example 1 further includes the leveling sections 13 provided on the carriage 10 serving as the first holding section. The locations of the leveling sections 13 can be changed between a leveling position P1 contacting the ejection region R, onto which the pretreatment liquid on the medium M is ejected and a non-leveling position P2 in non-contact with the ejection region R.

The printing apparatus 1 of Example 1 includes the leveling section 13 on the carriage 10 for holding the pretreatment liquid head 12 capable of applying the pretreatment liquid to the medium M, allowing leveling of the medium M, to which the pretreatment liquid is applied, in an efficient apparatus configuration.

The leveling section 13 of Example 1 includes a contact member 14 to contact the medium M, when the leveling section 13 is located at the leveling position P1, and an arm member 15 to connect the contact member 14 and the carriage 10.

The arm member 15 swings about a swing support 16 in the rotating direction D relative to the carriage 10, and thus the leveling section 13 can be located between the leveling position P1 and the non-leveling position P2.

Thus, the leveling section 13 of Example 1 includes the contact member 14 and the arm member 15, and the leveling section 13 is configured to displace between the leveling position P1 and the non-leveling position P2 by the swing of the arm member 15 with respect to the carriage 10. Therefore, by swinging the arm member 15, the location of the leveling section 13 can be changed easily between the leveling position P1 and the non-leveling position P2.

Note that as to the leveling section 13 of Example 1 is configured to be able to swing between the leveling position P1 and the non-leveling position P2 by driving the arm member motor 34 by the controller 25, but the leveling section 13 of Example 1 is not limited to such a configuration.

The contact member 14 of Example 1 serves as a roller to contact the medium M (or applies a pressure onto the medium M) by its own weight.

The roller is configured to be able to rotate with respect to the arm member 15.

Therefore, the roller is configured to level the medium M while rotating, when the carriage 10 is moved in the scanning direction B with the leveling section 13 located at the leveling position P1.

Note that the contact member 14 may not be limited in particular, and any member other than the roller may be used.

As described above, the printing apparatus 1 of Example 1 is configured such that the carriage 10 reciprocates in the scanning direction B, and the pretreatment liquid head 12 ejects the pretreatment liquid in accordance with the reciprocating movement of the carriage 10.

As illustrated in FIGS. 5 and 6, the leveling section 13 is provided on the carriage 10 to move with the pretreatment liquid head 12.

Therefore, the printing apparatus 1 of Example 1 can increase the number of the reciprocating movements (i.e., the number of times of leveling of the leveling section 13) of the carriage 10 relative to the medium M (ejection region R) by ejecting the pretreatment liquid in multipaths, and level the medium M effectively.

Note that the term "multipaths" indicates a method of ejecting liquid to a predetermined part of the medium M from the pretreatment liquid head 12 while the carriage 10 is reciprocating multiple times in the scanning direction B.

Specifically, as illustrated in FIGS. 5 to 7, the leveling section 13 of Example 1 includes the first leveling section 13*a* provided on one side (a first side) of the pretreatment liquid head 12 in the scanning direction B, and the second leveling section 13*b* on the other side (a second side) of the pretreatment liquid head 12 in the scanning direction B.

Therefore, the printing apparatus 1 of Example 1 enables effective leveling of the medium M by using the leveling sections (the first and second leveling sections 13*a* and 13*b*).

Note that the printing apparatus 1 of Example 1 is configured such that, as illustrated in FIG. 5, the controller 25 controls the leveling section 13 to locate the first leveling section 13*a* at the leveling position P1 and the second leveling section 13*b* at the non-leveling position P2 when the pretreatment liquid head 12 moves from the first side toward the second side in the scanning direction B (or moves in the going direction B1), while the controller 25 controls the leveling section 13 to locate the second leveling section 13*b* at the leveling position P1 and the first leveling section 13*a* at the non-leveling position P2 when the pretreatment liquid head 12 moves from the second side toward the first side in the scanning direction B (or moves in the returning direction B2).

Therefore, the printing apparatus 1 of the Example 1 is configured such that, undesired interference between the leveling section 13 and the medium M can be prevented in a case where the medium M is leveled by the leveling section 13 on the rear side in the movement direction of the pretreatment liquid head 12 (the first leveling section 13*a* moving in the going direction B1 and the second leveling section 13*b* moving in the returning direction B2), in comparison with a case where the leveling section 13 on the front side in the movement direction of the pretreatment liquid head 12 (the second leveling section 13*b* moving in the going direction B1 and the first leveling section 13*a* moving in the returning direction B2) levels the medium M.

For example, in a case where the medium M is leveled by the leveling section 13 located on the front side of the movement direction of the pretreatment liquid head 12, the leveling section 13 on the front side may hook the medium M to adversely affect the reciprocating movement of the carriage 10 or may generate a wrinkle W in the medium M, as illustrated in FIG. 6, depending on the type of the medium M in use.

The printing apparatus 1 of Example 1, however, is also configured such that, in a case where, for example, the medium M, which is less likely to be hooked and which is not easily leveled by the leveling section 13 is used, the leveling sections 13 on both rear side and front side in the movement direction of the pretreatment liquid head 12 can be used to level the medium M, as illustrated in FIG. 6.

In addition, the printing apparatus 1 of the Example 1 is configured such that the controller 25 is capable of controlling the ejection of the pretreatment liquid to the ejection region R in multipaths (a method of ejecting the liquid onto a predetermined part of the medium M from the pretreatment liquid head 12 while the carriage 10 is reciprocating multiple times in the scanning direction B).

In other words, the carriage 10 is configured to travel with the leveling section 13 multiple times in the scanning direction B over such a predetermined part of the medium M.

Thus, the printing apparatus 1 of Example 1 is configured to allow the carriage 10 and the leveling section 13 to travel multiple times in the scanning direction B over the predetermined part of the medium M (the ejection region R). Therefore, the number of reciprocating movements of the carriage 10 (i.e., the number of times of leveling by the leveling section 13) can be increased, and effective leveling of the medium M can be achieved.

As described above, the printing apparatus 1 of Example 1 includes the print head 7 serving as the second ejecting section capable of ejecting ink used as the image forming liquid, and the carriage 6 for holding the print head 7 and serving as the second holding section capable of reciprocating in the scanning direction B.

The controller 25 controls such that, in the reciprocating movements of the carriages 10 and 6, the start and stop timings of movement of the carriage 10 respectively coincide with the start and stop timings of movement of the carriage 6.

The printing apparatus 1 of Example 1 is configured such that the medium M is transported by a predetermined amount in the tray movement direction A while the carriages 10 and 6 are stopped, and the transportation of the medium M is stopped when the carriages 10 and 6 move (eject) (or the movement of the carriages 10 and 6 and the transportation of the medium M are carried out alternately). Thus, the driving timings of the carriages 10 and 6 and the transportation timing of the medium M can be controlled in simplified manner.

Note that "the start and stop timing of the carriage 10 coincides with the start and stop timing of the carriage 6" denotes that no substantial difference in timing between the carriages 10 and 6 may be allowed and therefore even a small difference in timing may be allowed.

More specifically, the printing apparatus 1 of Example 1 is configured such that the movement direction of the carriage 10 is opposite to the movement direction of the carriage 6 (i.e., the carriages 10 and 6 move alternately).

That is, when the carriage 10 moves in the going direction B1, the carriage 6 moves in the returning direction B2. When the carriage 10 stops on the first side of the scanning direction B, the carriage 6 stops on the second side of the scanning direction B. When the carriage 10 moves in the returning direction B2, the carriage 6 moves in the going direction B1.

Thus, in the printing apparatus 1 of Example 1, since the movement direction of the carriage 10 is opposite to the movement direction of the carriage 6, an occurrence of a large disproportion in weight balance of the printing apparatus 1 in the scanning direction B in accordance with the movement of the carriages 10 and 6 can be prevented.

A reciprocating speed of the carriages 10 and 6 may differ.

By making the reciprocating speed different between the carriages 10 and 6 by, for example, increasing the reciprocating speed of the carriage 10 to be faster than the reciprocating speed of the carriage 6, a sufficient amount of the pretreatment liquid can be applied and sufficient leveling can be carried out.

In addition, by making, for example, the reciprocating speed of the carriage 6 faster than the reciprocating speed of the carriage 10, a sufficient amount of ink can be applied.

Note that "making the reciprocating speed different between the carriages 10 and 6" may include a case where the movement speed is made different between the carriages 10 and 6, and may also include a case where the movement speed is the same between the carriages 10 and 6, but the stop time (time taken in changing the movement from one direction to the other direction) is made different between the carriages 10 and 6.

Meanwhile, the printing apparatus 1 of Example 1 includes a cleaning section 19 for cleaning the leveling section 13.

Thus, the printing apparatus 1 of Example 1 is capable of removing contamination or the like attached to the leveling section 13.

Specifically, as illustrated in FIG. 7, the printing apparatus 1 of the Example 1 includes the cleaning section 19 (a first cleaning section 19*a* corresponding to the first leveling section 13*a* and a second cleaning section 19*b*) at a home position (a waiting position while the carriage 10 is not driven) corresponding to the second leveling section 13*b*.

The cleaning section 19 includes a rotating section 17 for contacting a contact member 14 (roller) and rotating in a rotating direction D to rotate the contact member 14, and a brush 18 for contacting the contact member 14, which is made to rotate by the rotating section 17.

The cleaning section 19 of Example 1 is capable of moving in the tray movement direction A.

The cleaning section 19 moves into the home position for cleaning the leveling section 13 but moves away from the home position in not cleaning the leveling section 13.

Thus, the cleaning section 19 is configured not to interrupt the reciprocating movement of the carriage 10 in the scanning direction B.

However, the configuration of the cleaning section 19 is not limited in particular.

Note that at the home position of the printing apparatus 1, a cap 20 capable of capping the pretreatment liquid head 12 is provided.

FIG. 7 illustrates a state in which the pretreatment liquid head 12 is capped with the cap 20.

Note that the leveling sections 13 of Example 1 each include the arm member 15 for coupling the contact member 14 with the carriage 10, and the leveling sections 13 are configured to be able to displace between the leveling position P1 and the non-leveling position P2 by the swing of the arm member 15 about the swing support 16 in the rotating direction D relative to the carriage 10.

The leveling section 13 is not limited to such a configuration.

In the following, another example of the printing apparatus 1 will be described including another type of the leveling section 13, which is configured differently from the leveling section 13 of Example 1.

Figure 8:
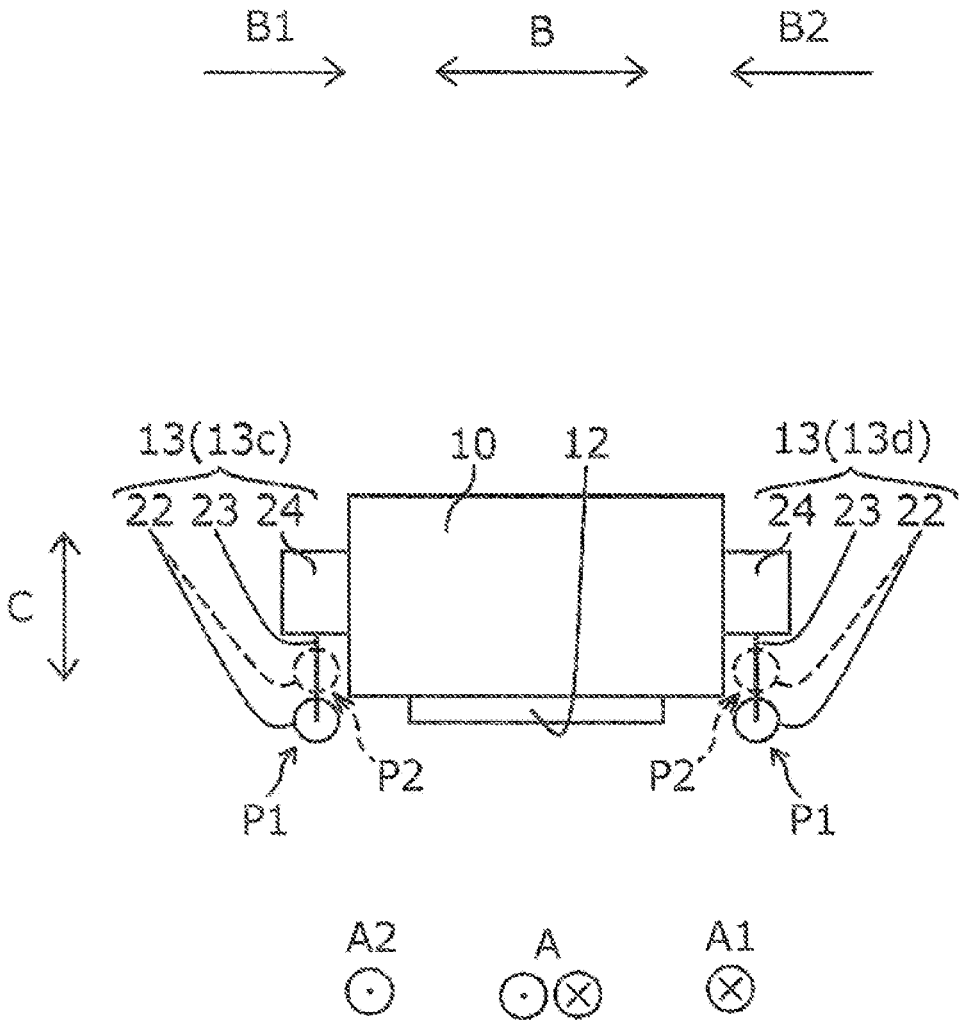
FIG. 8 is a schematic front view of major components of a printing apparatus according to Example 2 of the disclosure.

Example 2 (FIG. 8)

FIG. 8 is a schematic front view of a carriage 10, which is a major component of a printing apparatus 1 in Example 2.

Note that the same reference signs are given to the constituent components similar to the constituent components of Example 1 and detailed description of such constituent components is omitted.

Note that the printing apparatus 1 of Example 2 is configured similarly to the printing apparatus 1 of Example 1, except for the configuration of the leveling section 13 of the carriage 10.

As illustrated in FIG. 8, the leveling section 13 of Example 2 includes a first leveling section 13*c* and a second leveling section 13*d*.

The first leveling section 13*c* and the second leveling section 13*d* each include a roller-shaped contact member 22, an attachment section 23 of the roller-shaped contact member 22, and a movement section 24 capable of moving the attachment section 23 together with the contact member 22 in an attachment and detachment direction C (the vertical direction).

The movement section 24 lowers the contact member 22 to locate the leveling section 13 (contact member 22) at the leveling position P1, while the movement section 24 raises the contact member 22 to locate the leveling section 13 (the contact member 22) at the non-leveling position P2.

As described above, the printing apparatuses 1 of Examples 1 and 2 are configured such that the pretreatment liquid head 12 and the print head 7 are provided on different carriages.

Specifically, the pretreatment liquid head 12 is provided on the carriage 10 (first holding section), and the print head 7 is provided on the carriage 6 (second holding section).

However, such configurations are not limited.

In the following, still another example of the printing apparatus 1 will be described, in which the pretreatment liquid head 12 and the print head 7 are provided on the same carriage 37 (first holding section).

Figure 9:
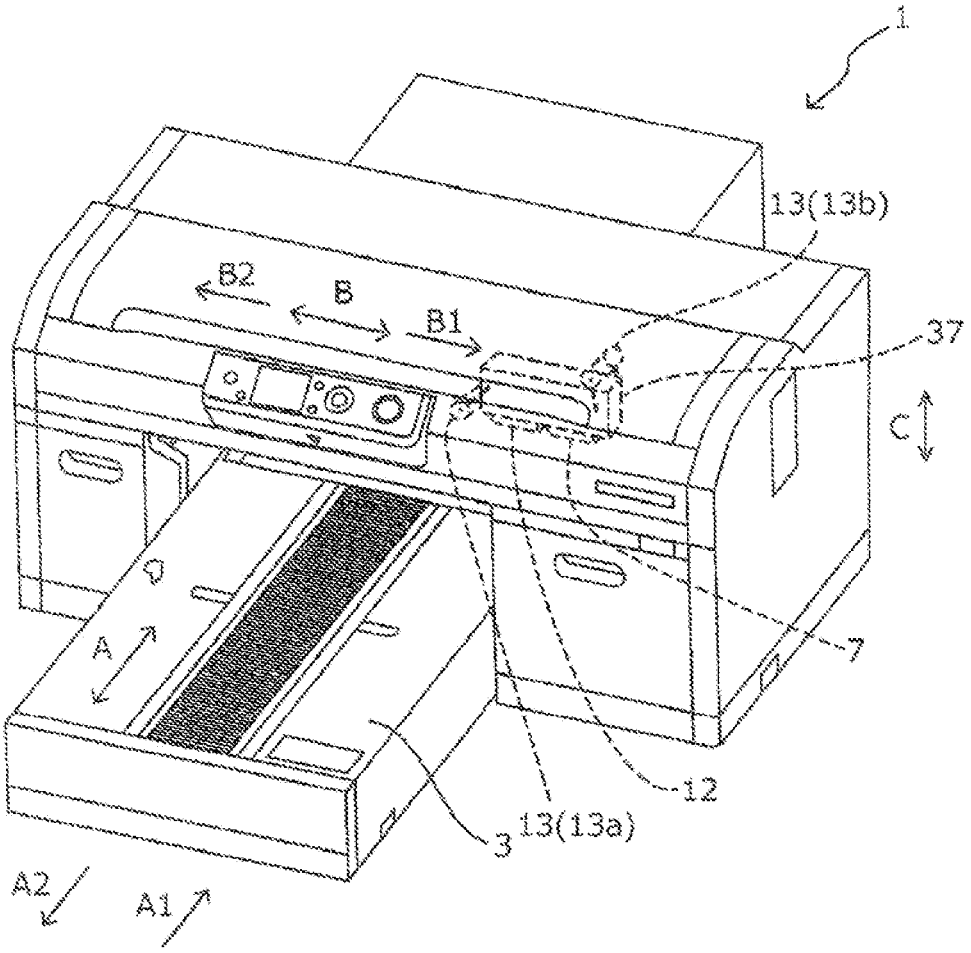
FIG. 9 is a schematic perspective view of a printing apparatus according to Example 3 of the disclosure.

Example 3 (FIG. 9)

FIG. 9 is a schematic perspective view of the printing apparatus 1 according to Example 3.

Note that the same reference signs are given to constituent components common to the constituent components of Examples 1 and 2, and the detailed description of such constituent components is omitted.

Note that the printing apparatus 1 of Example 3 is configured similarly to the printing apparatus 1 of Example 1, except that the pretreatment liquid head 12 and the print head 7 are provided on the same carriage that is a carriage 37.

The leveling section 13 of the printing apparatus 1 of Example 1 is configured similarly to the leveling section 13 of the printing apparatus 1 of Example 3.

As illustrated in FIG. 9, the carriage 37 of the printing apparatus 1 in Example 3 is capable of reciprocating in the scanning direction B.

The carriage 37 carries both the pretreatment liquid head 12 and the print head 7.

In addition, the carriage 37 includes the leveling section 13 (first and second leveling sections 13*a* and 13*b*).

The leveling section 13 is configured such that both first and second leveling sections 13*a* and 13*b* are located at the non-leveling position P2, as controlled by the controller 25 while the print head 7 is ejecting ink.

Thus, the carriage 37 holds both the ejecting section (print head 7) for ejecting the image forming liquid and the first ejecting section (pretreatment liquid head 12) for ejecting the pretreatment liquid. Therefore, the printing apparatus 1 of Example 3 eliminates the need for providing the holding section separately for holding the ejecting section for ejecting the image forming liquid.

In addition, the leveling section 13 is located at the non-leveling position P2 in the printing apparatus 1 of Example 3, when the print head 7 ejects ink. Therefore, while the image is being formed, the leveling section 13 touching the ink applied in the ejection region R and then reducing the image quality can be prevented.

Note that the disclosure is not limited to the examples described above, and various variations are available within the scope of the disclosure as recited in the appended claims, which also fall within the scope of the disclosure.

This application claims priority under 35 U.S.C. § 119 to Japanese Patent Application No. 2017-144212, filed Jul. 26, 2017. The entire disclosure of Japanese Patent Application No. 2017-144212 is hereby incorporated herein by reference.

What is claimed is:

1. A liquid ejecting apparatus, comprising:

a supporting section configured to support a medium;

a first ejecting section capable of ejecting a pretreatment liquid onto the medium supported by the supporting section;

a first holding section configured to hold the first ejecting section; and a leveling section provided on the first holding section and being capable of moving between a leveling position in contact with an ejection region onto which the pretreatment liquid is ejected and a non-leveling position in non-contact with the ejection region of the medium, wherein:

the first holding section is capable of performing a reciprocating movement in a scanning direction, the first ejecting section is configured to eject the pretreatment liquid in accordance with the reciprocating movement of the first holding section, the leveling section is provided at the first holding section to move with the first ejecting section, and the leveling section includes a first leveling section to be provided on a first side of the first ejecting section in the scanning direction and a second leveling section to be provided on a second side of the first ejecting section in the scanning direction.

2. The liquid ejecting apparatus according to claim 1, wherein the leveling section is configured such that:

in a case where the first ejecting section moves from the first side toward the second side in the scanning direction, the first leveling section is set as the leveling position and the second leveling section is set as the non-leveling position, and in a case where the first ejecting section moves from the second side toward the first side in the scanning direction, the second leveling section is set as the leveling position and the first leveling section is set as the non-leveling position.

3. The liquid ejecting apparatus according to claim 1, wherein the first holding section is configured to move a plurality of times together with the leveling section in the scanning direction over a predetermined part of the medium.

4. The liquid ejecting apparatus according to claim 1, further comprising:

a second ejecting section capable of ejecting an image forming liquid onto the ejection region, wherein the first holding section is configured to hold the second ejecting section, and the leveling section is configured to be located at the non-leveling position when the second ejecting section discharges the image forming liquid.

5. The liquid ejecting apparatus according to claim 1, wherein the leveling section includes a contact member configured to contact the medium when the leveling section is located at the leveling position, and an arm member configured to connect the contact member and the first holding section, and the leveling section is configured to displace between the leveling position and the non-leveling position by the swing of the arm member with respect to the first holding section.

6. The liquid ejecting apparatus according to claim 1, further comprising:

a cleaning section configured to clean the leveling section.

* * * * *